United States Patent [19]

Manthe et al.

[11] Patent Number: 4,845,459

[45] Date of Patent: Jul. 4, 1989

[54] CONTACT ARRANGEMENT OF A LOW-VOLTAGE CIRCUIT BREAKER WITH ELECTRO-DYNAMIC BREAKING

[75] Inventors: Karl-Heinz Manthe; Martin Boettcher; Bernhard Pfeiffer, all of Berlin, Fed. Rep. of Germany

[73] Assignee: Siemens Aktiengesellschaft, Berlin and Munich, Fed. Rep. of Germany

[21] Appl. No.: 248,421

[22] Filed: Sep. 23, 1988

[30] Foreign Application Priority Data

Sep. 23, 1987 [DE] Fed. Rep. of Germany ..... 3732468

[51] Int. Cl.[4] ..... H01H 77/10; H01H 75/02

[52] U.S. Cl. ..... 335/195; 200/147 R

[58] Field of Search ..... 335/195, 16; 200/147 R

[56] References Cited

U.S. PATENT DOCUMENTS 4,635,011 1/1987 Leone et al. ..... 335/16

FOREIGN PATENT DOCUMENTS 0209058 1/1987 European Pat. Off. .

2553930 4/1985 France .

1564412 4/1980 United Kingdom .

*Primary Examiner*—H. Broome

*Attorney, Agent, or Firm*—Kenyon & Kenyon

[57] ABSTRACT

A contact arrangement of a low-voltage circuit breakeer with electrodynamic breaking or opening. In contact arrangements which contain a compression spring for pretensioning a contact lever into the make position or after a dead center position is passed, the assembly is to be simplified and the use of an assembly fixture is to be made unnecessary. The pivot bearing of a contact lever at a contact lever carrier is formed by a pan-like depression of the contact lever carrier as well as an extension of the contact lever engaging the depression. Furthermore, a stop surface for the open position of the contact lever is arranged at the contact lever carrier. A brief application of force is sufficient for connecting the contact lever to the contact lever carrier. A current-limiting low-voltage circuit breaker of compact design is thus provided.

4 Claims, 2 Drawing Sheets

CONTACT ARRANGEMENT OF A LOW-VOLTAGE CIRCUIT BREAKER WITH ELECTRO-DYNAMIC BREAKING

BACKGROUND OF THE INVENTION

The present invention relates to a contact arrangement of a low-voltage circuit breaker with electrodynamic breaking or opening, with a pivoted contact lever carrier and a contact lever which is attached thereto and is pivoted relative thereto, as well as a compression spring braced against the contact lever carrier and the contact lever for pretensioning the contact lever into the make position, or after passing a dead center position of the contact lever with respect to the action direction of the compression spring into an opened position; further, having, a stop surface which is effective in the opened position of the contact lever for a back surface of the contact lever and a further stop surface provided at the contact lever carrier for the closed position of the contact lever.

A contact arrangement of this type has become known from British Patent No. A-1 564 412. There, the pivot bearing for the contact lever at the contact lever carrier has the form of a joint pin as is customary also in movable contact arrangements of low-voltage circuit breakers of other kinds. In the assembly of the movable contact arrangement it is therefore necessary to align a hole in the contact lever and corresponding holes in the contact lever carrier flush relative to each other so that the joint pin can be inserted. This process is made more difficult by the fact that the parts must be aligned against the force of the compression spring unless a relatively elaborate design of the contact lever carrier is provided which permits insertion of the compression spring after the contact lever and the contact lever carrier are joined together in an articulated manner.

SUMMARY OF THE INVENTION

It is an object of the invention to simplify the assembly consisting of the contact lever, the contact lever carrier and the compression spring such that an elaborate assembly fixture for the assembly of these parts can be dispensed with.

The above and other objects of the present invention are achieved by the provision that the pivot bearing of the contact lever at the contact lever carrier is formed by a panlike depression of the contact lever carrier as well as an extension of the contact lever engaging the depression, and that the striking surface for the opened position of the contact lever is arranged at the contact lever carrier.

The invention is based on the consideration that it is not necessary for forming a pivot bearing with a limited tilting angle to provide a shaft or pin support suitable for revolving rotary motions. This is because the cohesion of the parts pivoted relative to each other is ensured by the force of the compression spring which in this manner exerts a triple function. The latter consists, first, of the already mentioned maintenance of the cohesion between the contact lever and the contact lever carrier; secondly, of the generation of contact pressure between the contact lever and the fixed mating contact cooperating therewith in the closed position of the contact arrangement and, thirdly, of the sudden transfer into a breaking position, with the position of the contact lever carrier unchanged, under the influence of an electrodynamic force. Due to the self-centering property of a pan support, it is therefore sufficient to bring the contact lever with its extension into the proximity of the depression of the contact lever carrier and to thereby bring about the automatic engagement of the two parts. The stop surface for the back surface of the contact lever serves as the sliding surface for guiding the contact lever.

A contribution to the further facilitation of the assembly of the contact lever carrier and the contact lever can be made by the provision that the stop surface for the closing position of the contact lever at the contact lever carrier is arranged at an acute angle to the stop surface for the break position of the contact lever. The two stop surfaces form an approximately funnel-like opening of the contact lever carrier into which the contact lever can be inserted for assembly. In this connection, it has a particularly advantageous effect if the stop surface for the open position of the contact lever and the pan-like depression are connected by a gradual transition surface. It can be achieved thereby that the contact lever upon insertion into the contact lever carrier comes into engagement with the compression spring initially without force and then slides with its extension along the stop surface and the transition surface, in the process of which the compression spring is cocked. Then, the pin-like extension of the contact lever is automatically transferred into the pan-like depression of the contact lever carrier.

In the known contact lever arrangement mentioned at the outset, the contact lever carrier is a pocket-like part which is substantially open on one side. A flexible electrical connection of the contact lever with a fixed terminal is achieved by a current-carrying ribbon which is attached to an extension of the contact lever and which is brought around the contact lever carrier on the outside in an arc. According to a further embodiment of the invention, a production-wise more advantageous design of the contact lever carrier as well as a form advantageous for the current carrying ribbon can be achieved by the provision that the contact lever carrier has in the vicinity of the pan-like depression an opening on its side facing away from the stop surfaces for a current-carrying ribbon connected to the contact lever to pass through. Instead of the present pocket-like form, the contact lever carrier is thereby given a rather frame-like shape with a passage opening. The current-carrying ribbon thereby becomes shorter and can be connected to the contact lever where a relatively small relative motion occurs.

BRIEF DESCRIPTION OF THE DRAWINGS

In the following, the invention will be explained in greater detail, referring to the embodiment shown in the figures in which.

DETAILED DESCRIPTION

Figure 1:
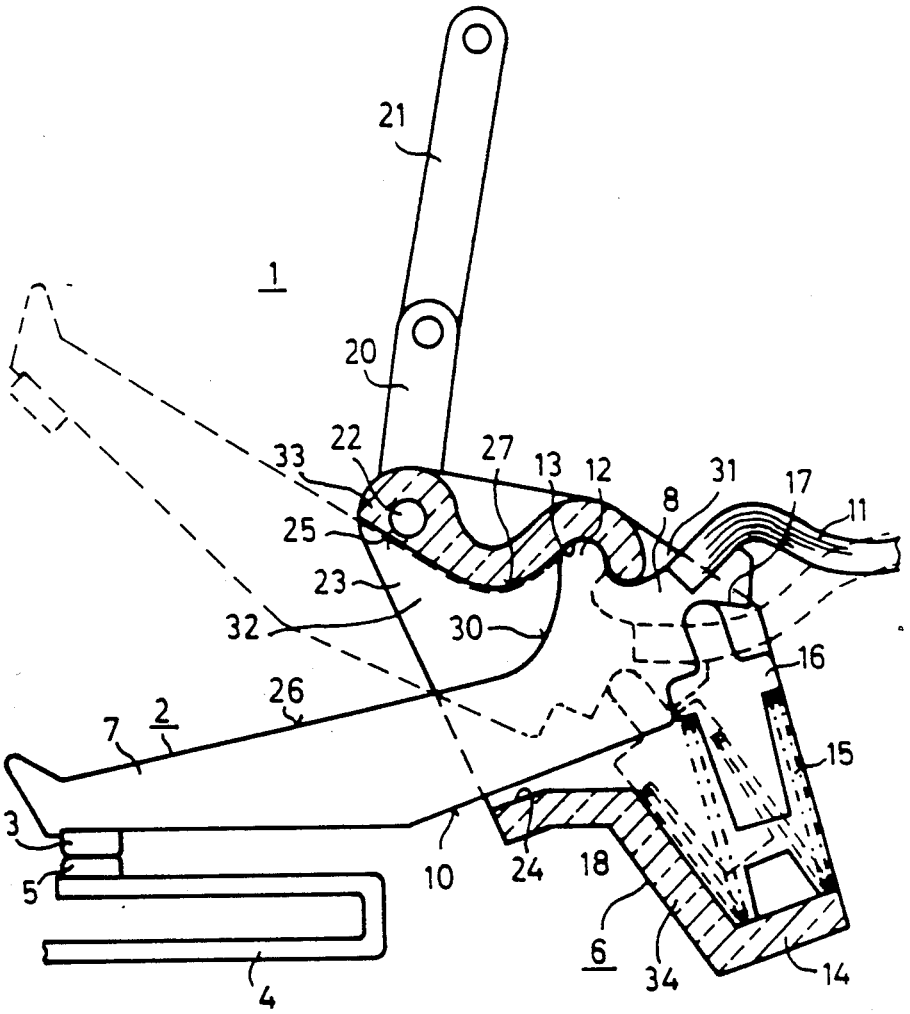
FIG. 1, shows a contact arrangement according to the invention in a side view, a contact lever carrier being shown in a cross section.

The contact arrangement of a low-voltage circuit breaker which is shown in FIG. 1 and designated generally with 1 comprises a contact lever 2 with a contact 3 located at its front end as well as a fixed loop-like conductor 4 with a further contact 5. The contact lever 2 is pivoted in a contact lever carrier 6, the contact lever carrier 6 being pivoted in turn in a manner known per se in a housing, not shown, of a circuit breaker. The contact lever 2 is designed as a two-armed lever with the lever parts 7 and 8, of which the lever part 7 provided with the contact 3 is substantially longer than the rear lever part 8, to which a flexible current-carrying ribbon 11 is attached for connecting the contact lever 2 to a fixed terminal. The pivot bearing of the contact lever 2 is formed by a rounded extension 12 which engages a depression 13 of the contact lever carrier 6 matched to the roundness of the extension.

The contact lever carrier 6 has a bottom part 14 which serves as a relatively stationary abutment of a helical compression spring 15 which engages the contact lever 2 by means of a pressure piece 16. For engaging the pressure piece at the contact lever 2, the lever part 8 thereof is provided with a fitting recess 17. As can be seen from FIG. 1, the compression spring 15 acts on the lever part 8 of the contact lever 2 in such a manner that it attempts to execute counterclockwise rotation about its extension 12. In this manner, the contact pressure required for making contact between the contacts 3 and 5 is generated if the contact lever carrier 6 is pre-tensioned counterclockwise. This is accomplished by a customary drive mechanism which is formed, for instance, by toggle levers 20 and 21 and which engages at a bearing pin 22 going through the contact lever carrier.

With the position of the contact lever carrier 6 unchanged, the contact lever 2 can be moved by a relatively large angle of rotation by the provision that the contact lever carrier has a suitably designed opening 23 which is limited by stop surfaces 24 and 25. In the ON position shown, a lower edge 10 of the contact lever 2 is lifted off the lower stop surface 24, whereby the compression spring 15 becomes effective for generating the contact pressure between the contacts 3 and 5. The contact lever 2 gets into the OPEN position shown dashed under the influence of electro-dynamic forces which are generated between the lever part 7 and the loop-shaped conductor 4 if the current is sufficiently large. In that case the contact lever 2 is flung away from the conductor 4, where the effective direction of the compression spring 15 passes through a dead center position with respect to the support point formed by the extension 12 and the depression 13, and subsequently becomes effective in the direction of opening the contact lever 2 further. The contact lever 2 then leans with a back surface 26 of the lever part 7 against the stop surface 25 of the contact lever carrier 6. Due to the fact that a gradual transition surface 27 is provided between the stop surface and the depression 13 of the contact lever carrier 6 and the contact lever 2 has a correspondingly shaped transition part 30 between the extension 12 and the back surface 26, contact comes about over a relatively large surface between the contact lever 2 and the contact lever carrier 6 and thereby, an advantageously low mechanical stress during the electrodynamic breaking process.

The described design of the contact lever carrier 6 with a stop surface 25 and a gradual transition surface 27 extending from the stop surface to the pan-like depression 13 further leads to a particularly simple assembly of the contact lever 2 at the contact lever carrier 6. To this end, the contact lever 2 is inserted into the funnel-like opening 23 which is limited by the stop surfaces 24 and 25, where the recess 17 first comes into connection with the pressure piece 16 of the compression spring 15, free of forces. If now the contact lever 2 is pushed further into the opening 23, the compression spring 15 is cocked with relatively little force due to the wedge effect, until the extension 12 gets into the recess 13, partially releasing the compression spring 15.

As already mentioned, a current-carrying ribbon 11 is fastened to the lever part 8 of the contact lever 2. This ribbon extends through a back opening 31 of the contact lever carrier 6 and thus is in an advantageous position with respect to the support of the contact lever 2 formed by the extension 12 and the depression 13. Furthermore, the current-carrying ribbon 11 is removed from the contacts 3 and 5 so far that a detrimental effect of the heat of an arc is impossible.

Figure 2:
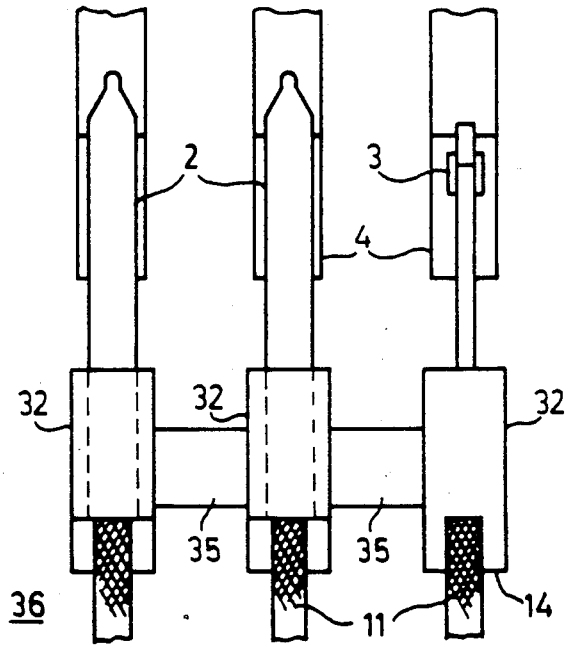
FIG. 2 shows a three-pole design of a contact arrangement in a top view.

Due to the arrangement of the openings 23 and 31, the contact lever carrier 6 has an approximately frame-like shape, the contact lever 2 being contained between side walls 32. In FIG. 1, the more backward of the two side walls 32 is visible due to the sectional view chosen. These side walls 32 are connected by two transverse legs 33 and 34, of which the upper transverse leg 33 has the stop surface 25 as well as the transition surface 27 and the depression 13, and the transverse leg 34 has the stop surface 24 and the bottom part 14. As can be seen from FIG. 2, several contact lever carriers 6 with wavy sections 35 can be connected to form a multipole switching shaft 36, depending on the number of poles of a switchgear, which is pivoted in the housing of a switchgear. In this manner, the normal ON and OFF-switching action is brought about, in which the contact lever or levers 2 substantially retain their position in the corresponding contact lever carrier 6. The lower edge 10 of the lever part 7 of the contact lever 2 merely leans against the stop surface 24 of the contact lever carrier 6 when switching off.

In the foregoing specification, the invention has been described with reference to a specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather that in a restrictive sense.

What is claimed is:

1. A contact arrangement of a low-voltage circuit breaker with electrodynamic contact opening, having a pivoted contact lever carrier and a contact lever attached thereto, the contact lever being pivoted relative to the carrier and further comprising a compression spring braced against the contact lever carrier and the contact lever for pretensioning the contact lever into the contacting position or, after passing a dead-center position of the contact lever with respect to the direction of action of the compression spring into an open position, the carrier further having a stop surface effective in the open position of the contact lever for engaging a back surface of the contact lever, the carrier further having a stop surface effective in the closed position of the contact lever, the contact lever having a pivot bearing formed in the contact lever carrier by a pan-like depression of the contact lever carrier and a corresponding extension of the contact lever engaging the depression, the stop surface for the open position of the contact lever being arranged on the contact lever carrier.

2. The contact arrangement recited in claim 1, wherein the stop surface for the closed position of the contact lever is arranged at an acute angle relative to the stop surface for the open position of the contact lever.

3. The contact arrangement recited in claim 1, wherein the stop surface for the open position of the contact lever and the pan-like depression are connected by a gradual transition surface.

4. The contact arrangement recited in claim 1, wherein the contact lever carrier has an opening near the pan-like depression on its side facing away from the stop surfaces for the passage of a current-carrying ribbon connected to the contact lever.

* * * * *